US009708149B2

(12) United States Patent
Arai et al.

(10) Patent No.: US 9,708,149 B2
(45) Date of Patent: Jul. 18, 2017

(54) SHEET PROCESSING APPARATUS INCLUDING STACKING TRAY ON WHICH SHEETS ARE STACKED, AND IMAGE FORMING SYSTEM

(71) Applicant: CANON KABUSHIKI KAISHA, Tokyo (JP)

(72) Inventors: Akihiro Arai, Toride (JP); Akinobu Nishikata, Abiko (JP); Takashi Yokoya, Yoshikawa (JP); Yutaka Ando, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/237,959

(22) Filed: Aug. 16, 2016

(65) Prior Publication Data

US 2017/0050817 A1 Feb. 23, 2017

(30) Foreign Application Priority Data

Aug. 20, 2015 (JP) ..... 2015-162995

(51) Int. Cl.
*B65H 43/02* (2006.01)
*B65H 31/10* (2006.01)
(Continued)

(52) U.S. Cl.
CPC ..... *B65H 43/02* (2013.01); *B65H 31/08* (2013.01); *B65H 31/10* (2013.01); *B65H 43/00* (2013.01);
(Continued)

(58) Field of Classification Search
CPC ..... B65H 31/08; B65H 31/10; B65H 43/00; B65H 43/02; B65H 43/08; B65H 2511/51; B65H 2511/515; B65H 2511/52
See application file for complete search history.

(56) References Cited

U.S. PATENT DOCUMENTS 5,328,169 A * 7/1994 Mandel ..... B65H 39/11 209/534
7,950,652 B2 * 5/2011 Terao ..... B65H 31/18 271/189
(Continued)

FOREIGN PATENT DOCUMENTS

JP H02-270162 A 11/1990
JP H03-13454 A 1/1991

*Primary Examiner* — David H Bollinger
(74) *Attorney, Agent, or Firm* — Rossi, Kimms & McDowell LLP

(57) ABSTRACT

A sheet processing apparatus capable of properly stacking sheets by detecting abnormality of a sheet stacking state during a sheet stacking operation to thereby prevent stack overflow. In the sheet processing apparatus, a conveyed sheet is stacked on a stacking tray. A sheet presence sensor detects a sheet on a sheet stacking surface of the stacking tray. A sheet height reduction sensor detects sheets within a predetermined distance downward from the uppermost surface of sheets stacked on the stacking tray. When the sheet presence sensor detects no sheet, and the sheet height reduction sensor detects a sheet during an operation for discharging a plurality of sheets onto the stacking tray, it is determined that an abnormal stacking state has occurred, and conveyance of a sheet is stopped.

6 Claims, 8 Drawing Sheets

ABNORMAL STACKING

(51) Int. Cl.
*B65H 43/00* (2006.01)
*B65H 43/08* (2006.01)
*B65H 31/08* (2006.01)

(52) U.S. Cl.
CPC ... *B65H 43/08* (2013.01); *B65H 2301/42124* (2013.01); *B65H 2511/51* (2013.01); *B65H 2511/515* (2013.01); *B65H 2511/52* (2013.01); *B65H 2801/06* (2013.01)

(56) References Cited

U.S. PATENT DOCUMENTS

| | | | | |
|---|---|---|---|---|
| 2004/0207152 | A1* | 10/2004 | Watanabe | B65H 31/10 271/294 |
| 2008/0185773 | A1* | 8/2008 | Yamamoto | B65H 31/26 271/176 |
| 2015/0307308 | A1* | 10/2015 | Ando | B65H 31/24 271/176 |

* cited by examiner

NORMAL STACKING

ABNORMAL STACKING

SHEET PROCESSING APPARATUS INCLUDING STACKING TRAY ON WHICH SHEETS ARE STACKED, AND IMAGE FORMING SYSTEM

BACKGROUND OF THE INVENTION

Field of the Invention

The present invention relates to a sheet processing apparatus that performs predetermined post-processing on sheets, and an image forming system including the sheet processing apparatus.

Description of the Related Art

Conventionally, there has been proposed a sheet discharge unit that detects a height of sheets stacked on a stacking tray, and determines whether or not the height of the sheets reaches a predetermined height to thereby detect stack overflow (see Japanese Patent Laid-Open Publication No. H02-270762). Further, there has been proposed an image forming apparatus that counts the number of sheets discharged onto a stacking tray, and compares the counted number with a limit number of discharged sheets to thereby detect overflow of sheets on the stacking tray (see Japanese Patent Laid-Open Publication No. H03-013454).

However, sheet processing apparatuses configured to discharge sheets onto a stacking tray include one provided with a stacking tray designed to have a sheet stacking surface bent in a sheet discharging direction.

FIGS. 8A and 8B are cross-sectional views of the stacking tray provided for the sheet processing apparatus, which has the sheet stacking surface bent in the sheet discharging direction. In this sheet processing apparatus provided with the stacking tray designed to have the sheet stacking surface bent in the sheet discharging direction, when a sheet having high rigidity is discharged onto the stacking tray, the sheet may not be stacked along the sheet stacking surface.

FIG. 8A shows a normal sheet stacking state in which sheets are stacked along the sheet stacking surface. On the other hand, FIG. 8B shows an abnormal sheet stacking state in which sheets are not stacked along the sheet stacking surface.

In general, on the sheet stacking surface of the stacking tray, there is provided a sheet presence sensor 715 that detects a sheet. However, in the abnormal stacking state in which sheets are not stacked along the sheet stacking surface, a sheet is not brought into contact with the sheet presence sensor 715, and hence the sheet is sometimes not detected with accuracy. In this case, it is impossible to determine whether sheets on the stacking tray have been removed by a user, or the abnormal stacking state in which a sheet cannot be normally detected has occurred, and hence it is difficult to detect stack overflow based on the number of stacked sheets and the like.

Further, since the sheets are not stacked along the sheet stacking surface of the stacking tray, a sheet stacking failure is highly likely to occur. When a sheet stacking failure occurs, sheets tend to fall, and if sheets continuously fall, it is difficult to detect stack overflow based on the height of stacked sheets.

SUMMARY OF THE INVENTION

The present invention provides a sheet processing apparatus that is capable of properly stacking sheets by detecting abnormality of a sheet stacking state during a sheet stacking operation to thereby prevent stack overflow, and an image forming system.

In a first aspect of the present invention, there is provided a sheet processing apparatus comprising a conveying unit configured to convey a sheet, a stacking tray on which a sheet conveyed by the conveying unit is stacked, a first sheet detection unit configured to detect a sheet on a sheet stacking surface of the stacking tray, a second sheet detection unit configured to detect a sheet within a predetermined range downward from the uppermost surface of sheets stacked on the stacking tray, and a control unit configured to cause the conveying unit to stop conveyance of a sheet in a case where the first sheet detection unit detects no sheet, and the second sheet detection unit detects a sheet during a sheet discharge operation for discharging a plurality of sheets onto the stacking tray.

In a second aspect of the present invention, there is provided an image forming system comprising an image forming unit configured to form an image on a sheet, a conveying unit configured to convey a sheet having an image formed thereon by the image forming unit, a stacking tray on which a sheet conveyed by the conveying unit is stacked, a first sheet detection unit configured to detect a sheet on a sheet stacking surface of the stacking tray, a second sheet detection unit configured to detect a sheet within a predetermined range downward from the uppermost surface of sheets stacked on the stacking tray, and a control unit configured to cause the conveying unit to stop conveyance of a sheet in a case where the first sheet detection unit detects no sheet, and the second sheet detection unit detects a sheet during a sheet discharge operation for discharging a plurality of sheets onto the stacking tray.

According to the present invention, it is possible to detect abnormality of the sheet stacking state in a state in which the first sheet detection unit detects no sheet on the sheet stacking surface of the stacking tray, and stop conveyance of a sheet by the conveying unit based on the detection, so that it is possible to properly stack sheets by preventing occurrence of stack overflow during a sheet stacking operation.

Further features of the present invention will become apparent from the following description of exemplary embodiments (with reference to the attached drawings).

DESCRIPTION OF THE EMBODIMENTS

The present invention will now be described in detail below with reference to the accompanying drawings showing embodiments thereof.

Figure 1:
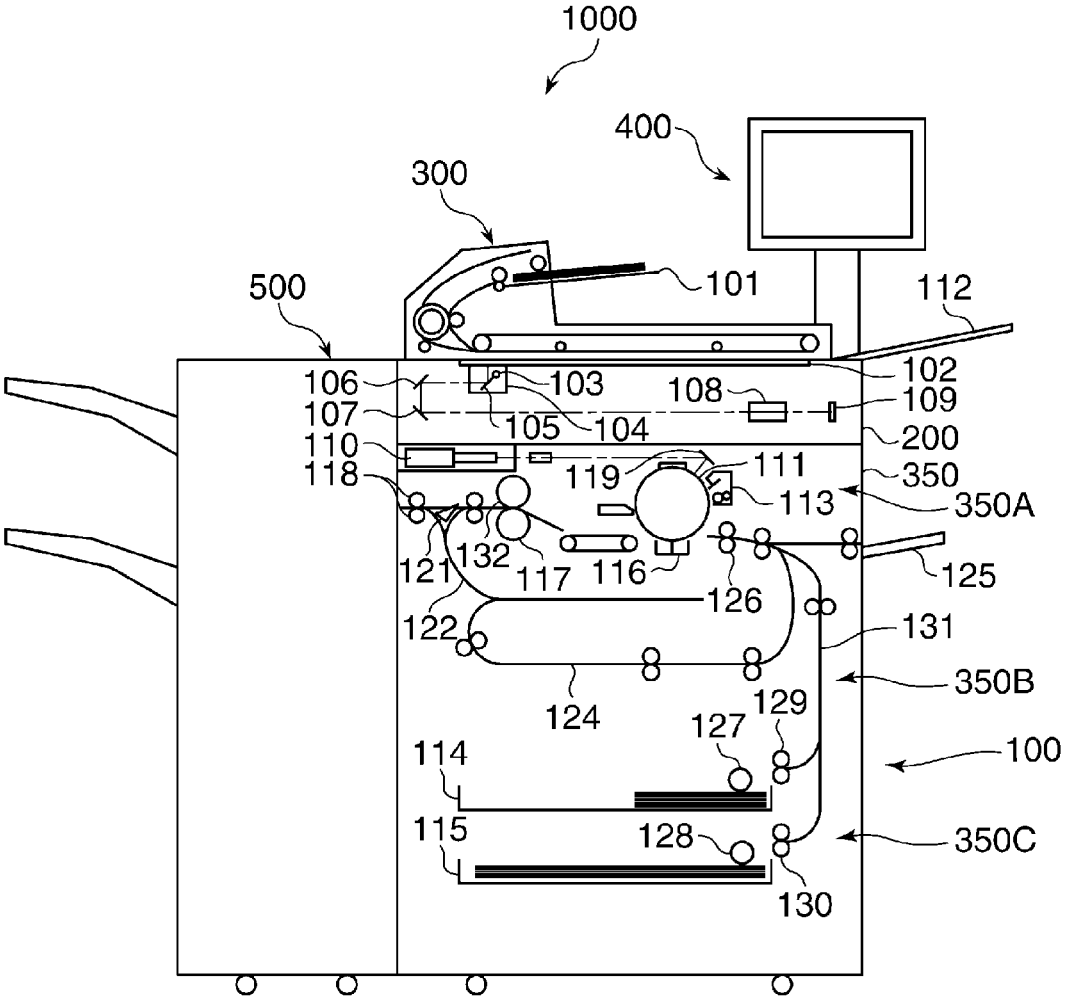
FIG. 1 is a schematic cross-sectional view of an image forming system provided with a sheet processing apparatus according to an embodiment of the invention.

FIG. 1 is a schematic cross-sectional view of an image forming system provided with a sheet processing apparatus according to an embodiment of the invention.

Referring to FIG. 1, the image forming system, denoted by reference numeral 1000, is basically comprised of an image forming apparatus 100, the sheet processing apparatus (finisher), denoted by reference numeral 500, and a console 400. The image forming apparatus 100 is comprised of an image reader 200 that reads an image from an original, a document feeder 300 that feeds an original to the image reader 200, and a printer 350 that forms the read image on a sheet.

The document feeder 300 is comprised of an original tray 101, a platen glass 102, and a discharge tray 112. The document feeder 300 feeds originals set on the original tray 101 with their front surfaces facing upward, one by one, starting with the leading page in a leftward direction as viewed in FIG. 1, such that each original is guided along a curved conveying path, then conveyed on the platen glass 102 from the left through a predetermined original reading position to the right, and discharged onto the discharge tray 112.

The image reader 200 is comprised of a scanner unit 104 including a lamp 103, mirrors 105, 106, and 107, a lens 108, and an image sensor 109.

The image reader 200 reads an image from an original by the image sensor 109 while the original is passing the predetermined image reading position on the platen glass 102 from the left to the right as viewed in FIG. 1. This image reading method is referred to as original flow reading.

The image reading position is a predetermined position at which reading of an original is performed on the platen glass 102, and refers to a position on the platen glass 102, which is opposed to a position at which the scanner unit 104 is fixed. When an original passes the predetermined image reading position on the platen glass 102 from the left to the right, an original image is read via the scanner unit 104 held in a manner opposed to the image reading position. At this time, light emitted from the lamp 103 of the scanner unit 104 is irradiated onto the original surface, and light reflected from the original is guided to the lens 108 via the mirrors 105, 106, and 107. The light having passed through the lens 108 is formed as an image on an image pickup surface of the image sensor 109, whereby the original image is read.

The optically read image is converted to image data by the image sensor 109, and the image data is output. The image data output from the image sensor 109 is input to an exposure device 110 of the printer 350, described hereafter, as a video signal.

Next, a description will be given of the configuration of the printer 350.

The printer 350 is comprised of an image forming section 350A, a conveying path 350B along which a sheet P as a recording sheet is conveyed to the image forming section, and a sheet storage section 350C for storing sheets P. The image forming section 350A is comprised of a photosensitive drum 111 as an image bearing member, the exposure device 110 disposed in a manner opposed to the photosensitive drum 111 and provided with a polygon mirror 119, and a developing device 113. The sheet storage section 350C is comprised of an upper cassette 114, a lower cassette 115, and a manual sheet feeder 125.

The conveying path 350B as a conveying passage includes a supply path 131 along which a sheet P is conveyed from the upper or lower cassette 114 or 115 to a transfer section 116 of the photosensitive drum 111 and a discharge path 132 along which the sheet P having an image formed thereon is discharged out of the image forming apparatus 100 via a fixing device 117. An inversion path 122 is connected to the discharge path 132 at a location downstream of the fixing device 117, and a double-sided conveying path 124 is connected to the inversion path 122.

On the supply path 131, there are provided pickup rollers 127 and 128 and conveying roller pairs 129 and 130 associated with the respective upper and lower cassettes 114 and 115, and a registration roller pair 126. On the discharge path 132, there are provided a switching flapper 121 disposed at a point downstream of the fixing device 117 where the inversion path 122 branches from the discharge path 132, and a conveying roller pair 118 for discharging the sheet P toward the downstream finisher 500.

In the printer 350 configured as above, the exposure device 110 modulates a laser beam based on the video signal input from the image reader 200 and forms an electrostatic latent image corresponding to the video signal by scanning the surface of the photosensitive drum 111 with light, using the polygon mirror 119. The developing device 113 supplies toner as a developer to the electrostatic latent image formed on the photosensitive drum 111, whereby the electrostatic latent image is visualized as a toner image.

On the other hand, the sheet P fed from the upper cassette 114 or the lower cassette 115 by the pickup roller 127 or 128 is conveyed to the registration roller pair 126 at rest by the conveying roller pair 129 or 130. When the sheet P reaches the registration roller pair 126, sheet information of the sheet P is notified from the image forming apparatus 100 to the downstream finisher 500 via a communication line. The sheet information includes information of a sheet size, a basis weight, a sheet material type (sheet material), a post-processing mode, and so forth.

The leading edge of the sheet P, conveyed along the supply path 131, is brought into abutment with the registration roller pair 126 and stops, and then the registration roller pair 126 conveys the sheet P to the transfer section 116 of the photosensitive drum 111 in timing synchronous with the start of laser beam irradiation. The toner image formed on the photosensitive drum 111 is transferred onto the sheet P by the transfer section 116. The sheet P having the toner image transferred thereon is conveyed into the fixing device 117, and is heated and pressed by the fixing device 117, whereby the toner image is fixed onto the sheet P. The sheet P having passed through the fixing device 117 is discharged toward the finisher 500 via the switching flapper 121 and the conveying roller pair 118.

When the sheet P is to be discharged face-down, i.e. with an image-formed surface thereof facing downward, the sheet P having passed through the fixing device 117 is once guided into the inversion path 122 by a switching operation of the switching flapper 121. Then, after the trailing edge of the sheet P has left the switching flapper 121, the sheet P is switched back to be discharged from the printer 350 by the discharge roller pair 118. Such inversion discharging mentioned as above is performed when image formation is performed on sheets starting with the leading page, e.g. in a case where images read using the document feeder 300 are formed, or in a case where images output from a computer are formed. At this time, the sheets discharged are in ascending order.

Further, when an image is formed on a hard sheet P, such as an OHP sheet, which is fed from the manual sheet feeder 125, the sheet P is discharged from the printer 350 by the conveying roller pair 118 with an image-formed surface thereof facing upward without guiding the sheet P to the inversion path 122.

On the other hand, in the case of double-sided printing in which images are formed on both sides of a sheet P, the sheet P having an image formed on a first side thereof is guided into the inversion path 122 by the switching operation of the switching flapper 121, and is then switched back to be further conveyed to the double-sided conveying path 124. Then, the sheet P is conveyed from the double-sided conveying path 124 to the transfer section 116 of the photosensitive drum 111 again in predetermined timing, followed by an image being formed on a second side of the sheet P.

Figure 2:
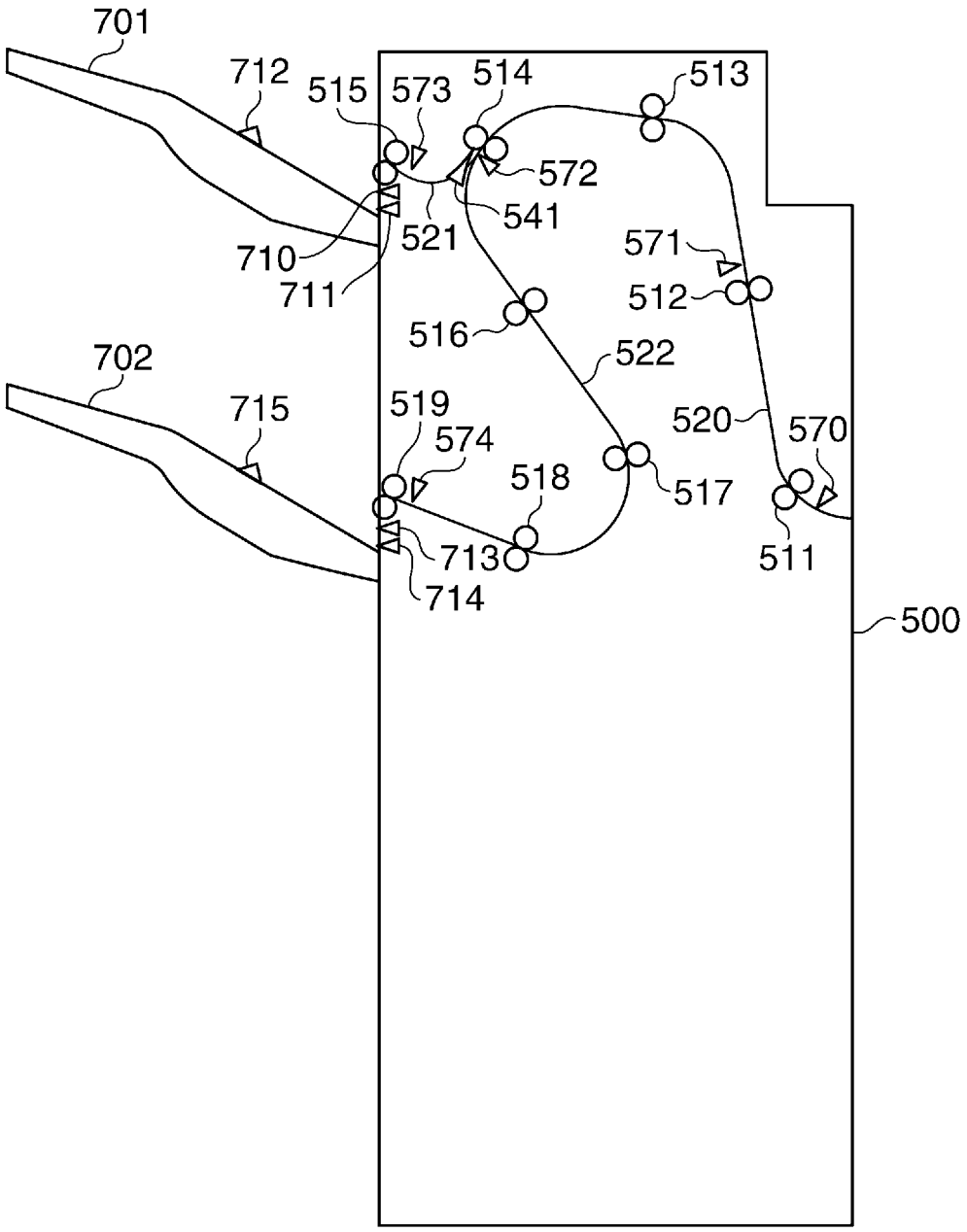
FIG. 2 is a schematic cross-sectional view of a finisher appearing in FIG. 1.

Next, a description will be given of the configuration of the finisher 500. FIG. 2 is a schematic cross-sectional view of the finisher 500 appearing in FIG. 1.

The finisher 500 has a conveying path 520 along which a sheet P discharged from the printer 350 is taken in and conveyed, an upper conveying path 521 connected to the conveying path 520, along which the sheet P is conveyed to an upper stacking tray 701, and a lower conveying path 522 along which the sheet P is conveyed to a lower stacking tray 702.

On the conveying path 520, there are arranged conveying roller pairs 511, 512, 513, and 514, along a conveying direction of a sheet P, in the mentioned order. A conveyance sensor 570 is disposed upstream of the conveying roller pair 511, and a conveyance sensor 571 is disposed downstream of the conveying roller pair 512. Further, a conveyance sensor 572 is disposed downstream of the conveying roller pair 514.

The conveying path 520 branches into the upper conveying path 521 and the lower conveying path 522 at a location downstream of the conveyance sensor 572. At a point of branching of the upper conveying path 521 and the lower conveying path 522, there is disposed a switching flapper 541. The switching flapper 541 is driven by a solenoid SL1, referred to hereinafter.

On the upper discharge path 521, there is arranged a conveying roller pair 515, and a conveyance sensor 573 is disposed upstream of the conveying roller pair 515. Further, on the lower conveying path 522, there are arranged conveying roller pairs 516, 517, 518, and 519, and a conveyance sensor 574 is disposed upstream of the conveying roller pair 519. The conveyance sensors 573 and 574 detect respective sheets P to be discharged onto the upper stacking tray 701 and the lower stacking tray 702, respectively.

The upper stacking tray 701 and the lower stacking tray 702 are each formed to be gentler in inclination of the sheet stacking surface with respect to a downstream part thereof than to a upstream part thereof in the sheet conveying direction. That is, the upper stacking tray 701 and the lower stacking tray 702 are each inclined such that the downstream part thereof in the sheet conveying direction is larger in the angle of inclination from the horizontal perpendicular to a side surface of the finisher 500 on which the upper stacking tray 701 and the lower stacking tray 702 are mounted than the upstream part thereof in the sheet conveying direction.

The sheet stacking surfaces of the upper stacking tray 701 and the lower stacking tray 702 are provided with sheet presence sensors 712 and 715, respectively, each as a sheet detection unit configured to detect presence or absence of a sheet on the sheet stacking surface. The upper stacking tray 701 and the lower stacking tray 702 can be lifted up and down by tray lift motors M5 and M6, respectively.

On a wall surface of the finisher 500 at a location upstream of the upper stacking tray 701 in the sheet conveying direction, there are arranged a sheet surface sensor 710 for detecting the uppermost surface of sheets stacked on the upper stacking tray 701 and a sheet height reduction sensor 711 disposed at a predetermined distance downward from the sheet surface sensor 710, for detecting part of the stacked sheets or the upper stacking tray 701 within a predetermined distance downward from the uppermost surface of sheets stacked on the upper stacking tray 701. Further, on the wall surface of the finisher 500 at a location upstream of the lower stacking tray 702 in the sheet conveying direction, there are arranged a sheet surface sensor 713 for detecting the uppermost surface of sheets stacked on the lower stacking tray 702 and a sheet height reduction sensor 714 disposed at a predetermined distance downward from the sheet surface sensor 713, for detecting part of the stacked sheets or the lower stacking tray 702 within a predetermined distance downward from the uppermost surface of sheets stacked on the lower stacking tray 702.

The sheet height reduction sensors 711 and 714 each detect removal of sheets stacked on the stacking tray or falling of sheets from the stacking tray, through a change in the state thereof from a detection state in which a sheet stacked on the associated stacking tray is detected to a non-detection state in which no sheet is detected.

A sheet surface detection operation is performed based on the outputs from the sheet surface sensor 710 and the sheet height reduction sensor 711, and the sheet surface sensor 713 and the sheet height reduction sensor 714. Details of the sheet surface detection operation will be described hereinafter.

The finisher 500 configured as above sequentially takes in sheets P discharged from the image forming apparatus 100 into the conveying path 520 by the conveying roller pair 511 driven by an inlet motor M1. Each sheet P taken in by the conveying roller pair 511 is conveyed via the conveying roller pairs 512 and 513 similarly driven by the inlet motor M1. At this time, the conveyance sensors 570 and 571 each detect passage of the sheet P.

When the sheet P is discharged onto the upper stacking tray 701, the switching flapper 541 is driven to switch the conveying destination to the upper conveying path 521. As a result, the sheet P is guided to the upper conveying path 521 by the conveying roller pair 514 driven by a conveying motor M2, and is discharged onto the upper stacking tray 701 by the conveying roller pair 515 driven by a discharge motor M4. The conveyance sensors 572 and 573 each detect passage of the sheet P.

When the sheet P is discharged onto the lower stacking tray 702, the switching flapper 541 is driven to switch the conveying destination to the lower conveying path 522. As a result, the sheet P is guided to the lower conveying path 522 by the conveying roller pair 514 driven by the conveying motor M2. Then, the sheet P is conveyed by the conveying roller pairs 516, 517, and 518, which are driven by the discharge motor M4, and is discharged onto the lower stacking tray 702 by the conveying roller pair 519 driven by the discharge motor M4. At this time, the conveyance sensor 574 detects passage of the sheet P.

Next, a description will be given of the configuration of the whole image forming system 1000 including a controller that controls the overall operation of the image forming system 1000 shown in FIG. 1.

Figure 3:
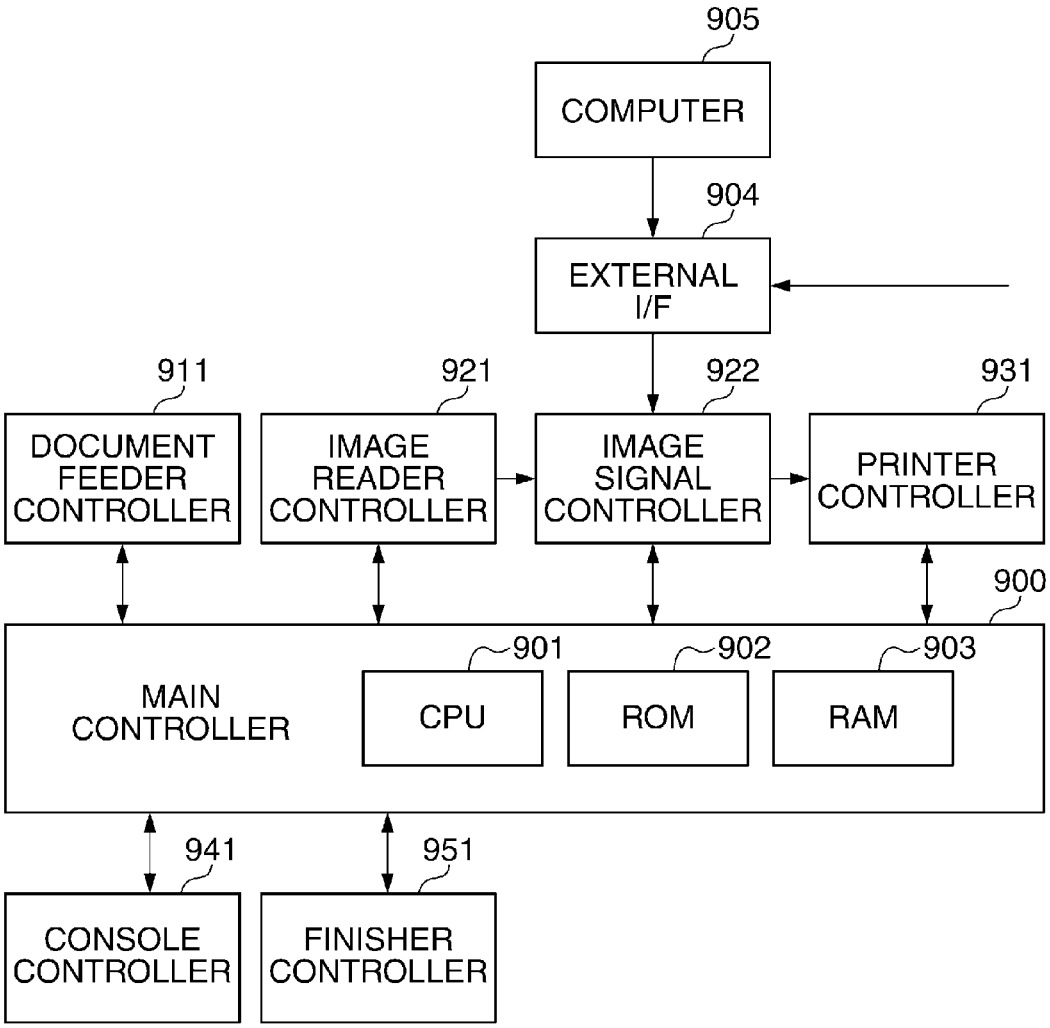
FIG. 3 is a control block diagram of the image forming system shown in FIG. 1.

FIG. 3 is a control block diagram of the image forming system 1000 shown in FIG. 1.

Referring to FIG. 3, the image forming system 1000 has a main controller 900 as a controller, and the main controller 900 includes a CPU 901 as system control means, a ROM 902, and a RAM 903. The CPU 901 performs basic control of the whole image forming system 1000, and is connected by an address bus and a data bus to the ROM 902 having control programs written therein and the RAM 903 for use in performing processing.

The CPU 901 is connected to controllers 911, 921, 922, 904, 931, 941, and 951, and performs centralized control of these according to the control programs stored in the ROM 902. The controllers include the document feeder controller 911, the image reader controller 921, the image signal controller 922 the external interface 904, the printer controller 931, the console controller 941, and the finisher controller 951. The RAM 903, which temporally holds control data, is used as a work area for arithmetic operations involved in control processing.

The document feeder controller 911 controls the driving of the document feeder 300 based on instructions from the main controller 900. The image reader controller 921 controls the driving of the aforementioned scanner unit 104 and image sensor 109 and transfers an analog image signal output from the image sensor 109 to the image signal controller 922.

The image signal controller 922 performs various processing after converting an analog image signal from the image sensor 109 to a digital signal, and converts the digital signal to a video signal to output the video signal to the printer controller 931. Further, the image signal controller 922 performs various processing on a digital image signal input from a computer 905 via the external interface 904, converts the digital image signal to a video signal, and outputs the video signal to the printer controller 931. Processing operations by the image signal controller 922 are controlled by the main controller 900. The printer controller 931 controls the printer 350 including the exposure device 110 based on the input video signal to thereby perform image formation and sheet conveyance.

The console controller 941 exchanges information with the console 400 and the main controller 900. The console 400 has a plurality of keys for configuring various functions concerning image formation, a display section that displays information indicating a configuration state, and so forth. The console 400 outputs a key signal corresponding to an operation of each key to the main controller 900. Further, based on a signal from the main controller 900, the console 400 displays corresponding information on the console 400.

The finisher controller 951 is installed in the finisher 500, and controls the driving of the whole finisher 500 by exchanging information with the main controller 900. Details of the control will be described hereinafter.

Figure 4:
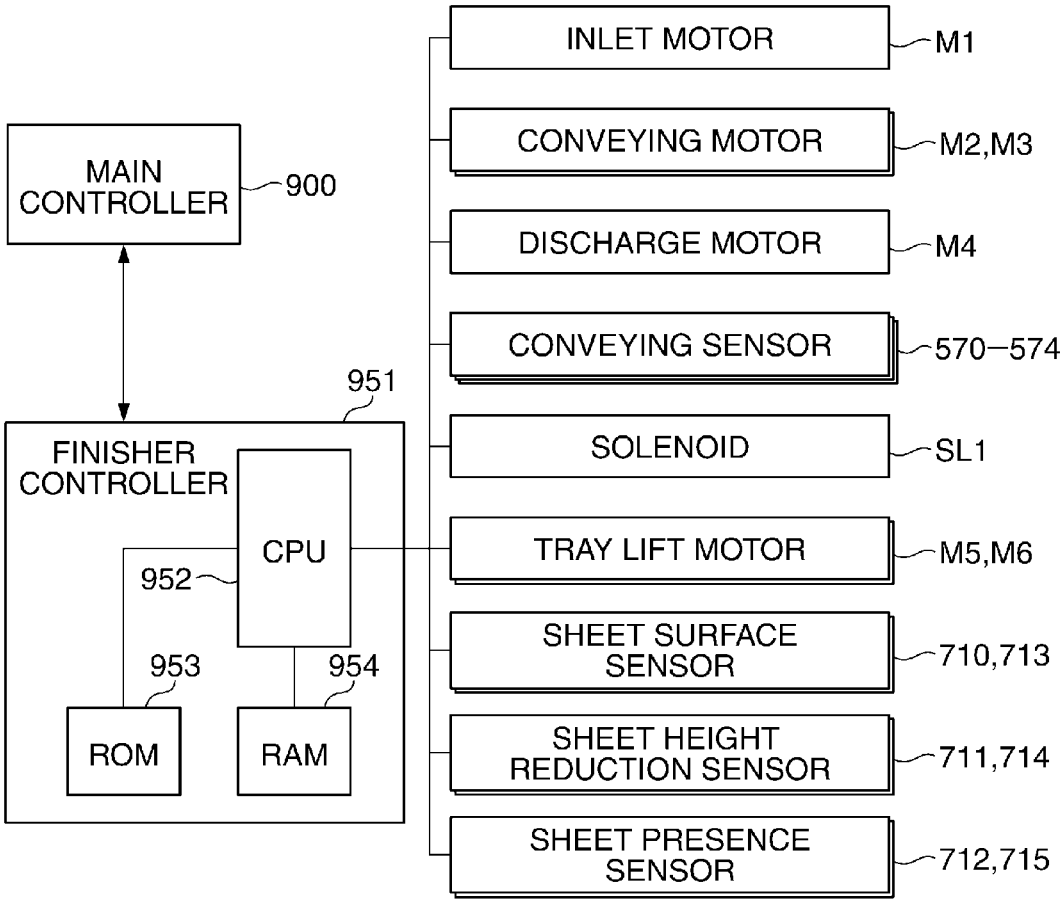
FIG. 4 is a block diagram of a finisher controller appearing in FIG. 3.

Next, a description will be given of the control configuration of the finisher 500. FIG. 4 is a block diagram of the finisher controller 951 appearing in FIG. 3.

Referring to FIG. 4, the finisher controller 951 includes a CPU 952, a ROM 953, and a RAM 954. The finisher controller 951 communicates with the main controller 900 provided in the image forming apparatus 100 via a communication IC to exchange data. Further, the finisher controller 951 executes various programs stored in the ROM 953 according to instructions from the main controller 900, to thereby control the driving of the finisher 500.

The CPU 952 of the finisher controller 951 is connected to the inlet motor M1, the conveying motor M2 and a conveying motor M3, the discharge motor M4, the conveyance sensors 570 to 574, and the solenoid SL1. Further, the CPU 952 is connected to the tray lift motors M5 and M6, the sheet surface sensors 710 and 713, the sheet height reduction sensors 711 and 714, and the sheet presence sensors 712 and 715. The CPU 952 executes various programs stored in the ROM 953 according to instructions from the main controller 900, to thereby control the driving of the finisher 500.

The inlet motor M1 drives the conveying roller pairs 511, 512, and 513 to convey sheets. The conveying motor M2 drives the conveying roller pair 514. The conveying motor M3 drives the conveying roller pairs 516, 517, and 518. The discharge motor M4 drives the conveying roller pairs 515 and 519. The conveyance sensors 570 to 574 detect passage of a sheet. The solenoid SL1 drives the switching flapper 541 to switch a destination of sheet conveyance (discharge destination).

Further, the tray lift motor M5 lifts up and down the upper stacking tray 701, and the tray lift motor M6 lifts up and down the lower stacking tray 702. The sheet presence sensors 712 and 715 detect sheets on the upper stacking tray 701 and the lower stacking tray 702, respectively. The sheet surface sensors 710 and 713 detect the uppermost surface of sheets stacked on the upper stacking tray 701 and the uppermost surface of sheets stacked on the lower stacking tray 702, respectively. The sheet height reduction sensor 711 detects part of the stacked sheets or the upper stacking tray 701 within a predetermined distance downward from the uppermost surface of the stacked sheets on the upper stacking tray 701, and the sheet height reduction 714 detects part of the stacked sheets or the lower stacking tray 702 within a predetermined distance downward from the uppermost surface of the stacked sheets on the lower stacking tray 702. It is determined whether or not to lift up the upper stacking tray 701 and the lower stacking tray 702, based on results of detection output from the sheet height reduction sensors 711 and 714, respectively.

Next, a description will be given of a first stack overflow detection process performed by the image forming system shown in FIG. 1 based on a sheet stacking process for discharging sheets onto the lower stacking tray 702. The first stack overflow detection process is a process for detecting stack overflow based on a height of a stacked sheet bundle.

Figure 5:
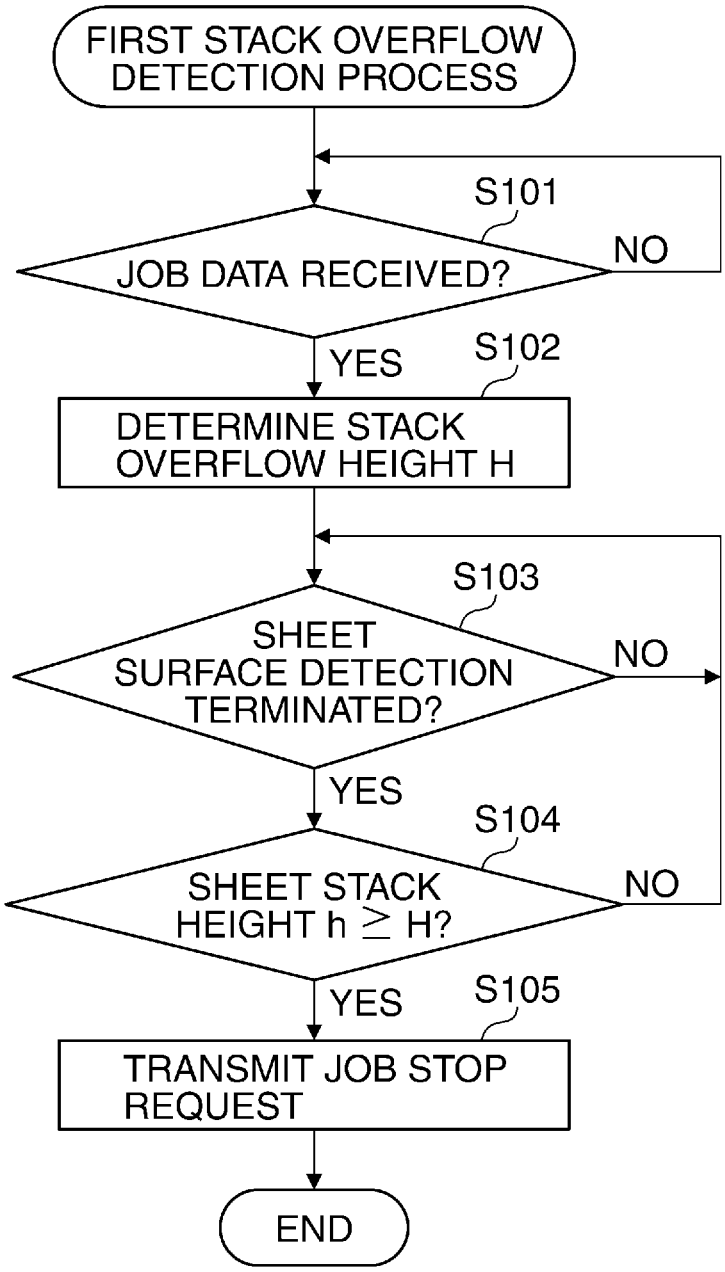
FIG. 5 is a flowchart of a first stack overflow detection process.

FIG. 5 is a flowchart of the first stack overflow detection process. The first stack overflow detection process is performed by the CPU 952 of the finisher controller 951 of the finisher 500 according to a first stack overflow detection process program stored in the ROM 953.

Referring to FIG. 5, when the first stack overflow detection process is started, the CPU 952 determines whether or not job data for sheet processing has been received from the main controller 900 of the image forming apparatus 100 via the communication IC, and waits until job data is received (step S101). Upon receipt of job data for sheet processing from the main controller 900, the CPU 952 proceeds to a step S102. In this step, the CPU 952 determines a stack overflow height H [mm] based on the sheet basis weight [g/m$^2$], the sheet material, post-processing information, and so forth, which are included in the received job data (step S102).

The stack overflow height H is different depending on whether or not to perform post-processing in the finisher 500, the type of post-processing, and so forth. For example, in a case where sheet bundles each of which has been subjected to stapling are stacked, the stack overflow height H is set to a value lower than in a case where sheets are stacked without being subjected to stapling. This is because in the case where sheet bundles each of which has been subjected to stapling are stacked, the sheet height of portions including staples becomes larger, and hence the stack overflow height H is reduced to thereby prevent detection delay of stack overflow of the sheet bundle, and prevents the collapse of stacked sheet bundles.

After determining the stack overflow height H [mm], the CPU 952 determines whether or not the sheet surface detection operation is terminated, and waits until the sheet surface detection operation is terminated (step S103).

The sheet surface detection operation refers to an operation for detecting the uppermost sheet surface of sheets stacked on the stacking tray, and adjusting the position of the stacking tray in the vertical direction such that a distance between the sheet discharge port from which a sheet is discharged onto the stacking tray and the uppermost sheet surface of the sheets on the stacking tray is held constant.

In the following, a description will be given of the sheet surface detection operation on the stacking tray, performed by the finisher 500, with reference to FIGS. 8A and 8B, referred to hereinabove. In the following description, it is assumed that the stacking tray appearing in FIGS. 8A and 8B is the lower stacking tray 702.

Figure 8A:
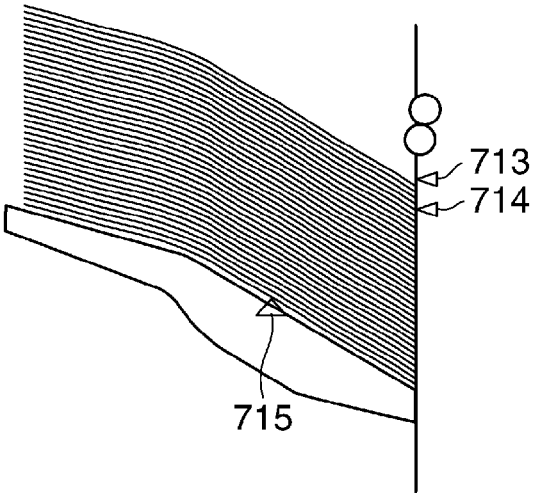
FIG. 8A is a cross-sectional view of a normal stacking state of a stacking tray having a sheet stacking surface not flat, which is provided for a sheet processing apparatus.
Figure 8B:
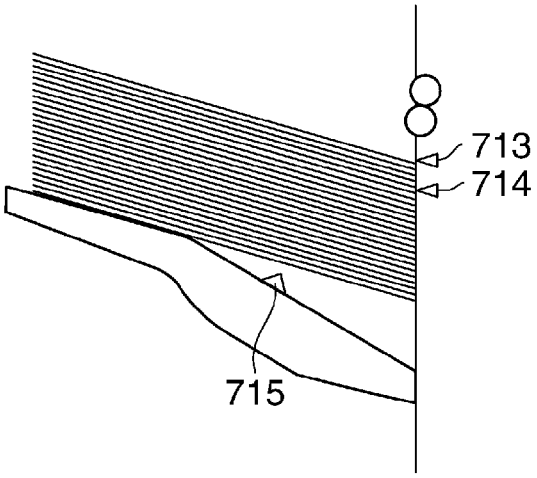
FIG. 8B is a cross-sectional view of an abnormal stacking state of the stacking tray appearing in FIG. 8A.

In FIG. 8A, on the wall surface of the finisher 500, on which the lower stacking tray 702 is disposed, the sheet surface sensor 713 for detecting the uppermost sheet surface of sheets on the lower stacking tray 702 and the sheet height reduction sensor 714 for detecting part of the stacked sheets or the lower stacking tray 702 within a predetermined distance downward from the uppermost surface of the stacked sheets are arranged below the sheet discharge port with a predetermined distance therebetween.

The CPU 952 controls the lower stacking tray 702 provided with the sheet surface sensor 713 and the sheet height reduction sensor 714 such that the vertical position of the lower stacking tray 702 is always in the following state: the sheet surface sensor 713 is in a state not detecting the uppermost sheet surface of stacked sheets (off state), and also the sheet height reduction sensor 714 is in a state detecting part of the stacked sheets or the lower stacking tray 702 (on state).

More specifically, when sheets are continuously stacked on the lower stacking tray 702, whereby the sheet surface sensor 713 is turned on, the CPU 952 drives the tray lift motor M6 to lift down the lower stacking tray 702. Then, when the sheet surface sensor 713 is turned off, and also the sheet height reduction sensor 714 is on, the CPU 952 stops driving the tray lift motor M6 to thereby stop lifting down the lower stacking tray 702.

Further, when sheets stacked on the lower stacking tray 702 have been removed by the user, whereby the sheet height reduction sensor 714 is turned off (at this time, the sheet presence sensor 715 is also turned off), the CPU 952 drives the tray lift motor M6 to lift up the lower stacking tray 702. Then, when the sheet surface sensor 713 is off, and also the sheet height reduction sensor 714 is turned on, the CPU 952 stops driving the tray lift motor M6 to thereby stop lifting up the lower stacking tray 702.

As described above, the CPU 952 performs the sheet surface detection operation such that the distance between the sheet discharge port of the lower conveying path 522 and the uppermost sheet of stacked sheets on the lower stacking tray 702 is always held constant. The sheet surface detection operation on the upper stacking tray 701 is performed in the similar manner.

Referring again to FIG. 5, if it is determined in the step S103 that the sheet surface detection operation has been finished (YES to the step S103), the height h [mm] of the stacked sheets at that time (sheet stack height) is finally determined. This height of the stacked sheets (sheet stack height) can be calculated by calculating a distance by which the lower stacking tray 702 is lifted down by driving the tray lift motor M6 e.g. based on the number of driving pulses supplied to the tray lift motor M6. The CPU 952 determines whether or not the sheet stack height h [mm] calculated as above has reached the stack overflow height H [mm] which is a predetermined height (step S104). Then, the CPU 952 repeats the steps S103 and S104 until the sheet stack height h [mm] reaches the stack overflow height H [mm].

If it is determined in the step S104 that the sheet stack height h [mm] has reached the stack overflow height H [mm] (YES to the step S104), the CPU 952 judges that stack overflow is to occur, and proceeds to a step S105, wherein the CPU 952 transmits a job stop request to the CPU 901 of the image forming apparatus 100 via the communication IC (step S105), followed by terminating the present process.

According to the process in FIG. 5, the stack overflow height H [mm] is determined based on the sheet basis weight [g/m$^2$], the sheet material, the post-processing information, and so forth, which are included in the received job data (step S102). Then, it is determined whether or not the sheet stack height h [mm] has reached the stack overflow height H [mm] (step S104), and if the sheet stack height h [mm] has reached the stack overflow height H [mm], the job is requested to be stopped (step S105). This prevents occurrence of stack overflow, and prevents the collapse of stacked sheet bundles.

According to the present embodiment, the sheet surface sensors 710 and 713 (third sheet detection unit) for detecting the uppermost sheet surface of sheets stacked on the stacking tray are provided. This makes it possible to hold constant the distance between the position of the stacking tray in the vertical direction and the uppermost sheet surface of stacked sheets, and thereby prevent collision between sheets already discharged and a sheet being discharged onto the stacking tray, to thereby properly stack sheets.

Further, according to the present embodiment, when the sheet height reduction sensor 711 or 714 (second sheet detection unit) disposed at the predetermine distance downward from the associated sheet surface sensor 710 or 713 (first sheet detection unit), for detecting part of stacked sheets or the associated stacking tray within a predetermined distance downward from the uppermost surface of the stacked sheets, detects that the sheets stacked on the stacking tray have been removed, the associated tray lift motor M5 or M6 (lifting unit) lifts up the upper stacking tray 701 or lower stacking tray 702 (stacking unit) until the sheet surface sensor 710 or 713 detects stacked sheets or the stacking tray. This makes it possible to detect removal of the sheets on the stacking tray by the user, and continue stacking of sheets on the stacking tray.

Next, a description will be given of a second stack overflow detection process performed by the image forming system shown in FIG. 1, based on a sheet stacking process for discharging sheets onto the lower stacking tray 702. The second stack overflow detection process is a process for detecting stack overflow based on the number of stacked sheets, and is performed in parallel with the first stack overflow detection process.

Figure 6:
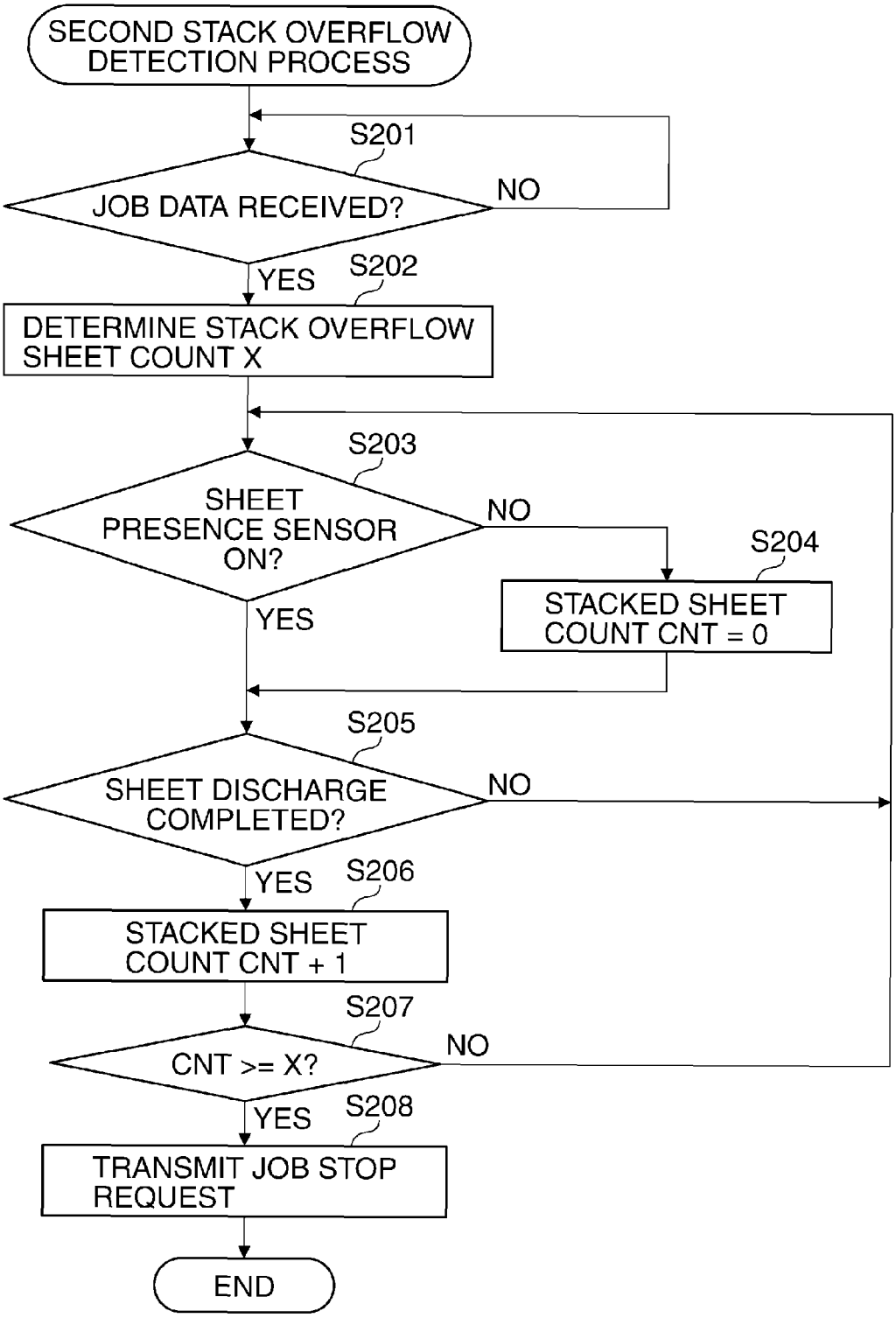
FIG. 6 is a flowchart of a second stack overflow detection process.

FIG. 6 is a flowchart of the second stack overflow detection process. The second stack overflow detection process is performed by the CPU 952 of the finisher controller 951 of the finisher 500 according to a second stack overflow detection process program stored in the ROM 953.

Referring to FIG. 6, when the second stack overflow detection process is started, the CPU 952 determines whether or not job data for sheet processing has been received from the main controller 900 of the image forming apparatus 100 via the communication IC, and waits until job data is received (step S201). Upon receipt of job data for sheet processing from the main controller 900, the CPU 952 proceeds to a step S202, wherein the CPU 952 determines a stack overflow sheet count X [number of sheets] based on the sheet basis weight [g/m$^2$], the sheet material, the post-processing information, and so forth, which are included in the received job data (step S202).

The stack overflow sheet count X is different depending on whether or not to perform post-processing in the finisher 500, the type of post-processing, and so forth. For example, in a case where sheet bundles each of which has been subjected to folding are stacked, the stack overflow sheet count X is set to a value smaller than in a case where sheets are stacked without being subjected to folding. This is because in the case where sheet bundles each of which has been subjected to folding are stacked, the height per one sheet is increased, and hence the stack overflow sheet count X is reduced to thereby prevent detection delay of stack overflow of stacked sheets, and prevents the collapse of stacked sheet bundles.

After determining the stack overflow sheet count X [number of sheets], the CPU 952 determines whether or not the sheet presence sensor 715 is on (step S203). If it is determined in the step S203 that the sheet presence sensor 715 is in a state detecting a sheet (on state) (YES to the step S203), the CPU 952 determines whether or not discharge of a sheet P onto the lower stacking tray 702 is completed (step S205).

If it is determined in the step S205 that discharge of a sheet P onto the lower stacking tray 702 is completed (YES to the step S205), the CPU 952 adds 1 to a stacked sheet count CNT [number of sheets] (step S206), and proceeds to a step S207, wherein the CPU 952 determines whether or not the stacked sheet count CNT has reached the stack overflow sheet count X (step S207). If it is determined in the step S207 that the stacked sheet count CNT has reached the stack overflow sheet count X (YES to the step S207), the CPU 952 judges that stack overflow is to occur, and proceeds to a step S208, wherein the CPU 952 transmits a job stop request to the CPU 901 of the image forming apparatus 100 via the communication IC (step S208), followed by terminating the present process.

On the other hand, if it is determined in the step S207 that the stacked sheet count CNT has not reached the stack overflow sheet count X which is the predetermined number of sheets (NO to the step S207), the CPU 952 returns to the step S203. That is, the CPU 952 continues to monitor the sheet presence sensor 715 and sheet discharge onto the lower stacking tray 702, and repeats the steps S203 to S207 until the stacked sheet count CNT reaches the stack overflow sheet count X.

Further, if it is determined in the step S203 that the sheet presence sensor 715 is not on (NO to the step S203), the CPU 952 clears the stacked sheet count CNT to zero (step S204), and then proceeds to the step S205.

Further, if it is determined in the step S205 that discharge of a sheet P to the lower stacking tray 702 is not completed (NO to the step S205), the CPU 952 returns to the step S203.

According to the process in FIG. 6, the stack overflow sheet count X [number of sheets] is determined based on the sheet basis weight [g/m$^2$], the sheet material, the post-processing information, and so forth, included in the received job data (step S202). Then, it is determined whether or not the stacked sheet count CNT [number of sheets] has reached the stack overflow sheet count X (step S207), and if the stacked sheet count CNT has reached the stack overflow sheet count X, the job is requested to be stopped (step S208). This prevents occurrence of stack overflow and prevents the collapse of stacked sheet bundles.

Next, a description will be given of an abnormal stacking state detection process performed by the image forming system shown in FIG. 1, based on a sheet stacking process for discharging sheets on the lower stacking tray 702.

Figure 7:
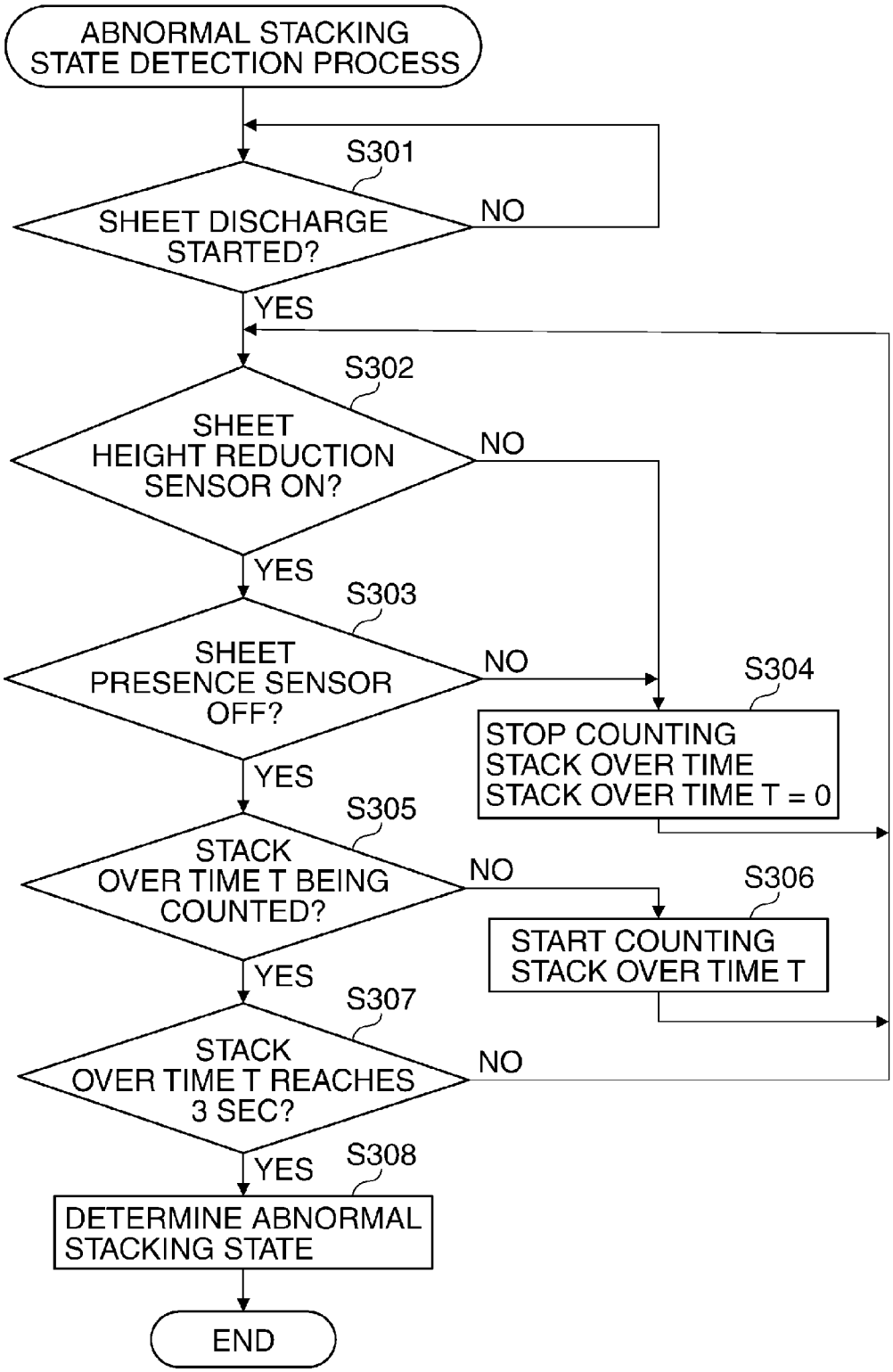
FIG. 7 is a flowchart of an abnormal stacking state detection process.

FIG. 7 is a flowchart of the abnormal stacking state detection process. The abnormal stacking state detection process is performed by the CPU 952 of the finisher controller 951 of the finisher 500 according to an abnormal stacking state detection process program stored in the ROM 953. The abnormal stacking state detection process is performed in parallel with the first stack overflow detection process and the second stack overflow detection process.

Referring to FIG. 7, when the abnormal stacking state detection process is started, the CPU 952 determines whether or not sheet discharge onto the lower stacking tray 702 has been started, and waits until sheet discharge is started (step S301). At this time, the CPU 952 determines that discharge of a sheet P onto the lower stacking tray 702 has been started, by receiving a signal indicative of detection of the sheet P from the conveying sensor 574 provided at the sheet discharge port from which each sheet is discharged to the lower stacking tray 702.

After discharge of a sheet P onto the lower stacking tray 702 has been started, the CPU 952 determines whether or not the sheet height reduction sensor 714 is on (step S302). If it is determined in the step S302 that the sheet height reduction sensor 714 is on (YES to the step S302), the CPU 952 determines whether or not the sheet presence sensor 715 is off (step S303).

If it is determined in the step S303 that the sheet presence sensor 715 is off (YES to the step S303), the CPU 952 determines whether or not a stack over time is being counted (step S305).

The stack over time refers to a time period which has elapsed after the abnormal stacking state of a sheet P stacked on the sheet stacking surface of the lower stacking tray 702 has occurred. The abnormal stacking state refers to a state in which although the sheet P has been discharged onto the lower stacking tray 702 (step S301), and the sheet height reduction sensor 714 is on (step S302), the sheet presence sensor 715 is off (step S303). This case is considered as the abnormal stacking state in which the sheet P discharged onto the lower stacking tray 702 is not stacked along the sheet stacking surface, an example of which is illustrated in FIG. 8B. This state may be spontaneously eliminated as the number of stacked sheets increases to cause the weight of the stacked sheets to be increased, and hence the stack over time is counted.

The stack over time as a time period which has elapsed after the abnormal stacking state has occurred is measured by the CPU 952 using a timer incorporated in the CPU 952.

If it is determined in the step S305 that the stack over time is being counted (YES to the step S305), the CPU 952 determines whether or not the stack over time T [ms] has reached e.g. three seconds (step S307). If it is determined in the step S307 that the stack over time T has reached three seconds (YES to the step S307), the CPU 952 judges that the abnormal stacking state of sheets P has occurred (step S308). This is because if the sheet presence sensor 715 continues to be not turned on even after sheet discharge is continued until the stack over time T reaches three seconds, the stacking state of the sheet P is less likely to recover the normal stacking state from the abnormal stacking state. After that, the CPU 952 transmits a job stop request to the CPU 901 of the image forming apparatus 100 via the communication IC, followed by terminating the present process. This is to prevent further problems, including falling of discharged sheets P from the lower stacking tray 702 due to the abnormal stacking state.

On the other hand, if it is determined in the step S307 that the stack over time T has not reached three seconds (NO to the step S307), the CPU 952 returns to the step S302.

Further, if it is determined in the step S305 that the stack over time is not being counted (NO to the step S305), the CPU 952 starts counting of the stack over time T (step S306), and returns to the step S302.

Further, if it is determined in the step S302 that the sheet height reduction sensor 714 is off, of if it is determined in the step S303 that the sheet presence sensor 715 is on, the CPU 952 proceeds to a step S304, wherein if the stack over time is being counted, the CPU 952 stops counting, clears the stack over time to zero (step S304), and returns to the step S302.

According to the process in FIG. 7, after an abnormal stacking state has occurred during the discharge operation, if the abnormal stacking state continues for a predetermined time period, e.g. three seconds (step S307), it is determined that the abnormal stacking state of stacked sheets has occurred (step S308), and a job stop request is transmitted. This makes it possible to immediately eliminate the abnormal stacking state.

In the present embodiment, a positional relationship between the sheet surface sensor 713 and the sheet height reduction sensor 714 is set to such a relationship that before a time point when each sheet P is discharged onto the lower stacking tray 702, both the sensors are placed in the following states, respectively: The sheet surface sensor 713 is in a most downward position from which it does not detect the uppermost sheet surface of stacked sheets, and the sheet height reduction sensor 714 is in a state detecting the lower stacking tray 702 or part of the stacked sheets on the lower stacking tray 702.

Although in the present embodiment, the description is given of the case where the sheets P are stacked on the lower stacking tray 702, also in a case where sheets are stacked on the upper stacking tray 701, stack overflow detection is performed in the similar manner.

In the present embodiment, stack overflow detection based on the abnormal stacking state is performed in parallel with stack overflow detection based on the height of stacked sheets described with reference to FIG. 5, and stack overflow detection based on the number of stacked sheets described with reference to FIG. 6. In any of the first and second stack overflow detection processes and the abnormal stacking state detection process, when stack overflow is detected earliest, the job is stopped. Therefore, it is possible to form a stack of sheets or a stack of sheet bundles by stacking sheets without largely spoiling stacking property, irrespective of whether the sheet stacking state is normal or abnormal. Further, in stack overflow detection, only one of the first and second stack overflow detection processes may be performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-162995 filed Aug. 20, 2015, which is hereby incorporated by reference herein in its entirety.

What is claimed is:

1. A sheet processing apparatus comprising:

a conveying unit configured to convey a sheet;

a stacking tray on which a sheet conveyed by said conveying unit is stacked;

a first sheet detector configured to detect a sheet on a sheet stacking surface of said stacking tray;

a second sheet detector configured to detect a sheet within a predetermined range downward from the uppermost surface of sheets stacked on said stacking tray; and a controller configured to cause said conveying unit to stop conveyance of a sheet in a case where said first sheet detector detects no sheet, and said second sheet detector detects a sheet during a sheet discharge operation for discharging a plurality of sheets onto said stacking tray.

2. The sheet processing apparatus according to claim 1, wherein when a state in which said first sheet detector detects no sheet and said second sheet detector detects a sheet continues for a predetermined time period during the sheet discharge operation, said controller causes said conveying unit to stop conveyance of a sheet.

3. The sheet processing apparatus according to claim 1, further comprising:

a lifting unit configured to lift up and down said stacking tray; and a third sheet detector disposed above said second sheet detector, and configured to detect the uppermost sheet surface of sheets stacked on said stacking tray, and wherein when said third sheet detector detects the uppermost sheet surface, said controller causes said lifting unit to lift down said stacking tray until the uppermost sheet surface is no longer detected by said third sheet detector.

4. The sheet processing apparatus according to claim 3, wherein when said second sheet detector detects no sheet, said controller causes said lifting unit to lift up said stacking tray until said second sheet detector detects a sheet or said stacking tray.

5. The sheet processing apparatus according to claim 1, wherein said stacking tray is inclined such that a downstream part thereof in a sheet conveying direction is larger in an angle of inclination from the horizontal perpendicular to a side surface of the sheet processing apparatus on which said stacking tray is mounted than an upstream part thereof in the sheet conveying direction.

6. An image forming system comprising:

an image forming unit configured to form an image on a sheet;

a conveying unit configured to convey a sheet having an image formed thereon by said image forming unit;

a stacking tray on which a sheet conveyed by said conveying unit is stacked;

a first sheet detector configured to detect a sheet on a sheet stacking surface of said stacking tray;

a second sheet detector configured to detect a sheet within a predetermined range downward from the uppermost surface of sheets stacked on said stacking tray; and a controller configured to cause said conveying unit to stop conveyance of a sheet in a case where said first sheet detector detects no sheet, and said second sheet detector detects a sheet during a sheet discharge operation for discharging a plurality of sheets onto said stacking tray.

* * * * *